US006357152B1

(12) United States Patent
Brooks et al.

(10) Patent No.: US 6,357,152 B1
(45) Date of Patent: Mar. 19, 2002

(54) ANIMATED DISPLAY SYSTEM AND METHOD OF FABRICATING SAME

(76) Inventors: Debbie S. Brooks; Paul-Philippe D'Auriac, both of 647 South Mountain, Gardiner, NY (US) 12525

( * ) Notice: Subject to any disclaimer, the term of this patent is extended or adjusted under 35 U.S.C. 154(b) by 0 days.

(21) Appl. No.: 09/547,835

(22) Filed: Apr. 12, 2000

Related U.S. Application Data

(60) Provisional application No. 60/129,958, filed on Apr. 19, 1999.

(51) Int. Cl.[7] ..... G09F 19/08
(52) U.S. Cl. ..... 40/419; 40/414
(58) Field of Search ..... 40/419, 418, 420, 40/417, 615, 416, 415, 411, 421, 423, 616; 446/301, 343, 347, 354, 352; 156/242; 106/506, 498; 428/480; 427/407

(56) References Cited

U.S. PATENT DOCUMENTS 1,897,918 A * 2/1933 Wagenhals
2,348,250 A * 5/1944 Gardner et al.
3,731,427 A * 5/1973 Lewis et al.
3,751,319 A * 8/1973 Green et al. ..... 40/615
4,089,130 A 5/1978 Byrnes
4,229,895 A 10/1980 Byers
4,608,771 A 9/1986 Mehta
4,803,796 A * 2/1989 Ottinger ..... 40/414
4,875,886 A * 10/1989 Sung ..... 40/419
5,649,379 A 7/1997 Hoffman et al.
5,784,815 A 7/1998 Hermanson
5,855,502 A 1/1999 Truchsess
5,870,842 A 2/1999 Ogden et al.
6,142,845 A * 11/2000 Feldman ..... 40/419

* cited by examiner

*Primary Examiner*—Douglas C. Butler
(74) *Attorney, Agent, or Firm*—Cummings & Lockwood

(57) ABSTRACT

A display system is disclosed which includes a base structure having a display surface, the display surface of the base structure having artwork provided thereon, at least one inanimate structural component having a display surface, the display surface of the at least one inanimate structural component having artwork provided thereon, the inanimate structural component mounted with respect to the display surface of the base structure in a predetermined orientation so as to achieve a desired artistic presentation, at least one animated structural component structural component having a display surface, the display surface of the at least one animated structural component having artwork provided thereon, the at least one animated structural component mounted for movement with respect to the base structure and the at least one inanimate structural component, a mechanical linkage assembly mounted to the base structure and connected the animated structural component to facilitate the relative motion thereof with respect to the composite structure and the at least one inanimate structural component, and a motor operatively associated with the mechanical linkage assembly for imparting motion to the animated structural component.

20 Claims, 5 Drawing Sheets

ANIMATED DISPLAY SYSTEM AND METHOD OF FABRICATING SAME

CROSS-REFERENCE TO RELATED APPLICATIONS

The subject application claims priority to U.S. Provisional Patent Application No. 60/129,958 filed Apr. 19, 1999, the disclosure of which is herein incorporated by reference in its entirety.

COPYRIGHT NOTICE

A portion of the disclosure of this patent documents contains material which is subject to copyright protection. The copyright owner has no objection to the reproduction by anyone of the patent documents or patent disclosure as in appears in the Patent and Trademark Office, patent file or records, but otherwise reserves all copyrights whatsoever.

BACKGROUND OF THE INVENTION

1. Field of the Invention

The subject invention relates to display systems, and more particularly, to an animated display system of an artistic nature and a method of fabricating such a system.

2. Background of the Related Art

Display systems with movable components are known in the art. For example, U.S. Pat. No. 5,784,815 to Hermanson discloses an animated display device in the form of a lighted sculpture simulating a character or object capable of synchronized motion in two different planes and about two transverse axes. The device that includes a vertical main drive shaft, a body rotatably secured to the main drive shaft and a drive device for driving the body to oscillate about the main shaft. In one embodiment, the display device also includes a rotatable appendage secured to the main body and a linkage for converting oscillating movement of the body about the main shaft into oscillating movement of the appendage. The main drive shaft is secured to a three-dimensional support stand for display purposes. Thus, the device cannot be mounted on a wall for display purposes. It would be beneficial however, to provide a three-dimensional animated display device that can be easily mounted on a wall for display purposes.

SUMMARY OF THE INVENTION

The subject invention is directed to a unique, artistically desirable animated display system and a unique method of fabricating the same. In accordance with a preferred embodiment of the subject invention, the display system includes a base structure having a display surface, wherein the display surface has artwork provided thereon. The system further includes at least one inanimate structural component having a display surface with artwork provided thereon is mounted with respect to the display surface of the base structure in a predetermined orientation so as to achieve a desired artistic presentation.

The system further includes at least one animated structural component having a display surface with artwork provided thereon is mounted for movement with respect to the base structure and the at least one inanimate structural component. In addition, the system includes a mechanical linkage assembly mounted to the base structure and connected the animated structural component to facilitate the relative motion thereof with respect to the composite structure and the at least one inanimate structural component, and a drive motor is operatively associated with the mechanical linkage assembly for imparting motion to the animated structural component.

Preferably, the display system of the subject invention further comprises a rechargeable power source for powering the motor, and switching means for controlling operation of the motor. The switching means may comprise a motion activated switch, a sound activated switch, a manually activated switch, or a light activated switch.

In accordance with a preferred embodiment of the subject invention, the method of fabricating a display system includes the steps of forming a substantially planar base structure having a display surface and a plurality of structural components each having a display surface, and providing artwork on the display surface of the base structure and each of the structural components. The method further includes the steps of applying lacquer to the display surface of the base structure and each of the structural components to enhance and preserve the artwork provided thereon, and arranging the plurality of structural components with respect to the display surface of the base structure in a predetermined orientation so as to achieve a desired artistic presentation. The method further includes the step of coating the base structure and plurality of structural components with a resin material so as to form the base structure and plurality of structural components into a composite structure.

Preferably, the method of the subject invention also includes the steps of providing at least one additional structural component having a display surface with artwork provided thereon, applying lacquer to the display surface of the at least one additional structural component, and mounting the at least one additional structural component to the composite structure in such a manner so as to facilitate relative motion of the at least one additional structural component with respect to the composite structure. In addition, the method includes the step of providing a motor and operatively associated mechanical linkage assembly for facilitating relative motion of the additional structural component with respect to the composite structure.

In accordance with a preferred embodiment of the subject invention, the step of forming a substantial planar base structure having a display surface and a plurality of structural components each having a display surface comprises the step of forming the base structure and plurality of structural components from a thermoplastic material. In addition, the step of providing artwork on the display surface of the base structure and each of the structural components comprises the step of providing an image produced by at least one of silk-screening, hand painting, or digital imaging. The method also includes the step of mounting an image on the display surfaces of the base structure and each of the structural components prior to the step of applying lacquer to the display surface of the base structure and each of the structural components.

Preferably, the step of applying lacquer to the display surface of the base structure and each of the structural components includes the step of applying at least three layers of lacquer to the display surface of the base structure and each of the structural components. Furthermore, the step of arranging the plurality of structural components with respect to the display surface of the base structure in a predetermined orientation preferably also includes securing the plurality of structural component and base structure to one another.

These and other features of the system and method of the subject invention will become more readily apparent to those having ordinary skill in the art from the following detailed description of the invention taken in conjunction with the drawings.

BRIEF DESCRIPTION OF THE DRAWINGS

So that those having ordinary skill in the art to which the disclosed system and method appertains will more readily understand how to use the same, reference may be had to the drawings wherein.

These and other features of the system and method of the subject invention will become more readily apparent to those having ordinary skill in the art from the following detailed description of the preferred embodiments taken in conjunction with the drawings.

DETAILED DESCRIPTION OF THE PREFERRED EMBODIMENTS

Figure 1:
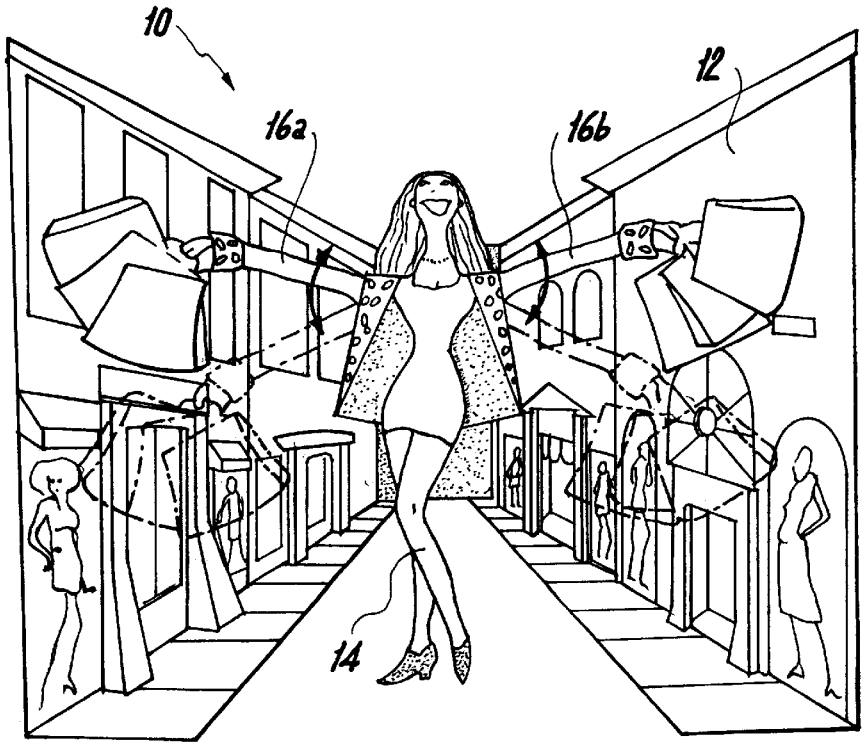
FIG. 1 is a front elevational view of an animated display system constructed in accordance with a preferred embodiment of the subject invention.

Referring now to the drawings wherein like reference numerals identify similar structural elements of the novel display system disclosed herein, there is illustrated in FIG. 1 a display system constructed in accordance with a preferred embodiment of the subject invention and designated generally by reference numeral 10.

Figure 2:
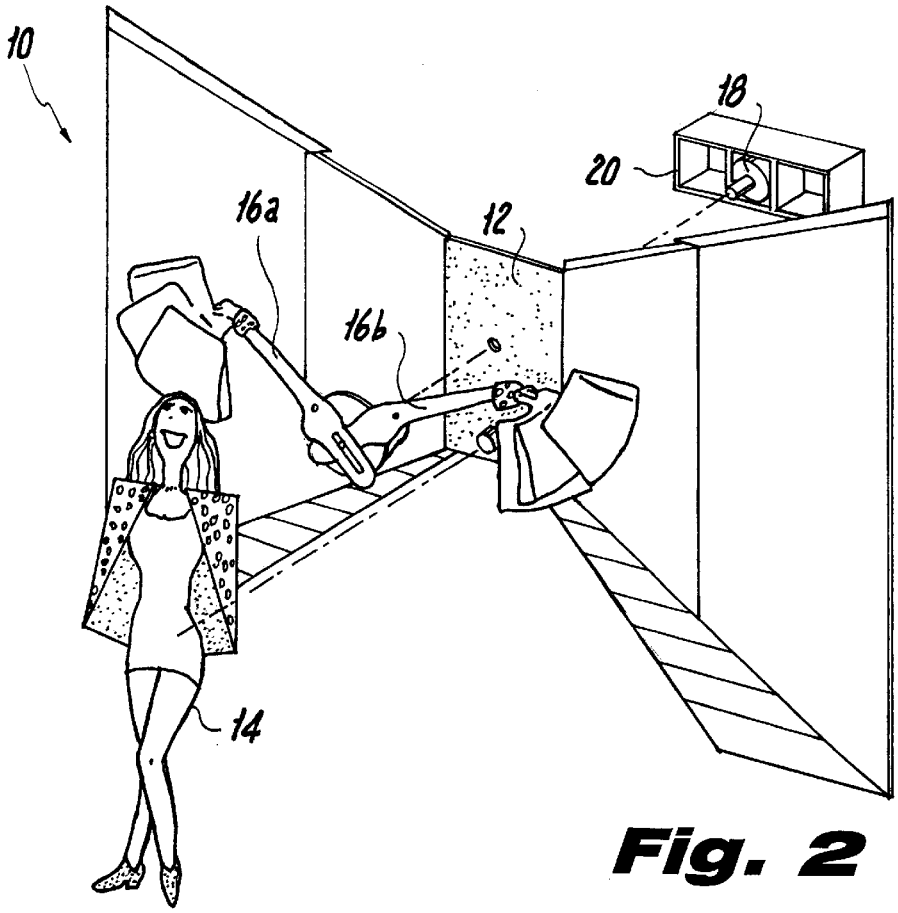
FIG. 2 is an exploded perspective view of the animated display system of FIG. 1 with parts separated for ease of illustration.

Referring to FIGS. 1 and 2, the display system 10 is, in and of itself, a hand-crafted work of art depicting a whimsical scene in a shopping venue. The display is adapted and configured to be mounted on a wall in a manner suitable for a work of art. In brief, display system 10 includes a base structure 12, a plurality of structural components including inanimate structural components 14 and animated structural components 16*a* and 16*b*, and a drive system 18 supported within a housing 20 that is attached to the base structure to impart motion to the animated structural components of the display system.

In accordance with the subject invention, the frame 12 and the structural components 12, 14 consist of a unique form of artwork. In particular, the artwork is constructed in a media that consists of a plastic material marketed under the tradename Sintra®, which is available from Alusuisse Composites Inc., of Benton, Ky. Sintra® is available in many solid colors, and in thickness stocks of ⅛" or ¼". For the subject invention, ⅛" stock is employed.

The structural components of the display system 10 of the subject invention are preferably formed using a ¼" masonite template. Each template is first hand drawn and hand cut on a scroll saw, and then temporarily glued to the Sintra® with a hot melt adhesive glue, or the like. With the template firmly secured to a working surface and the Sintra® temporarily glued on top of the template, a router is used to follow the contour of the template and cut the Sintra® to the desired shape of the template. The shaped plastic piece is then separated from the template, and hand painted with latex or acrylic paint. Thereafter, the shaped and painted structural component of Sintra® is transformed into a digital image for later use, by employing a computer system and associated digital scanner. It is envisioned that the plastic structural components can be formed into a desired shape using numerically controlled cutting devices available on the market today. It has been found that certain small highly detailed structural components employed in the subject display system may be difficult to fabricate using the Sintra® material. Thus, such intricate components may be fabricated from foamcore or wood.

The digital images generated by the computer system are printed on a high resolution color graphic printer. The printed images are then hand cut and glued to the Sintra® components with a spray mount adhesive. In accordance with a preferred embodiment of the subject invention, digital images bordered by a black line are spray mounted to black ⅛" Sintra® material and any perimeter outlining is done with an alcohol base marker. If necessary, the Sintra® components can be hand painted with latex paint to obtain preferred colors.

Some of the solid color components have complex black line designs, which are hand drawn, digitized, digitally touched-up using a graphical interface program at high magnification, and subsequently printed on clear acetate sheets. These sheet are then used to make a silk-screen. This is done for some color images and black line images. Some structural components are silk-screened directly, without prior painting, if the stock color of the Sintra® is acceptable. The decision to use a digital image in the artwork, or a silk-screen image, depends on many factors. However, most displays constructed in accordance with the subject invention use a combination of both processes.

Once the imaging process has been completed, each structural component of the display system of the subject invention, whether silk-screened, hand painted, hand bordered, or digitally imaged, is coated with lacquer. The lacquer, which is preferably applied by spray coating, does not adversely react with the imaging paper or the alcohol base marker used to generate the digital images. It has been found that if the pieces are not sprayed with lacquer, the resin coating used in the assembly process described hereinbelow will tend to have an adverse effect on the digital images, and the marker will tend to bleed into the clear resin. By coating each structural component with lacquer, each component is sealed in such a manner so that the resin bonds only with the lacquer coating, not with the underlying image.

Preferably, the lacquer coating is applied in at least three layers and all areas to be resined are completely coated. Each layer of lacquer is applied thinly to prevent the images from bleeding, and each layer is allowed to dry for at least 30 minutes before the next layer is applied. Once the desired number of layers has been applied, the components are left to dry for at least eight hours in temperature controlled environment, at a temperature of least 70° F.

Once dried, the structural components of the display system are secured to one another with a silicone material, or the like. In the case of display system 10, only the inanimate structural components are secured to one another in this manner. The silicone is provided to hold the components in spaced relationship to one another to achieve a desired artistic arrangement, until such time as the components are bonded together with resin to form an integral structure suitable or display. The silicone has a 30 minute set time, allowing the artist to arrange the relative positions of the components prior to the application of the resin. This becomes necessary as many of the structural components of the display are built-up or layered upon one another to achieve the desired artistic impression.

After the components are properly assembled and adhered to one another, the structure is dusted, touched-up, and checked for spots that were not coated with the lacquer. If necessary, an addition layer of lacquer may be applied to the components. Thereafter, the display is moved to a clean room for the application of the resin material. Preferably, a two-part resin composite is utilized, such as, for example, EnviroTex Lite® high-gloss resin, which is available from Environmental Technology, Inc., of Fields Landing, Calif. The resin bonds with the lacquer coating and achieves two distinct functions. First, the resin serves to bonds the individual structural components of the display system to one another to form a one-piece integral structure, wherein the components are permanently joined together. Second, the resin creates a permanent, durable coating that can be exposed to a normal household environment, and can be cleaned and maintained, without the need of a frame and glass. After the resin is applied, it is permitted to de-gas and cure in a warm dust free room.

Figure 3:
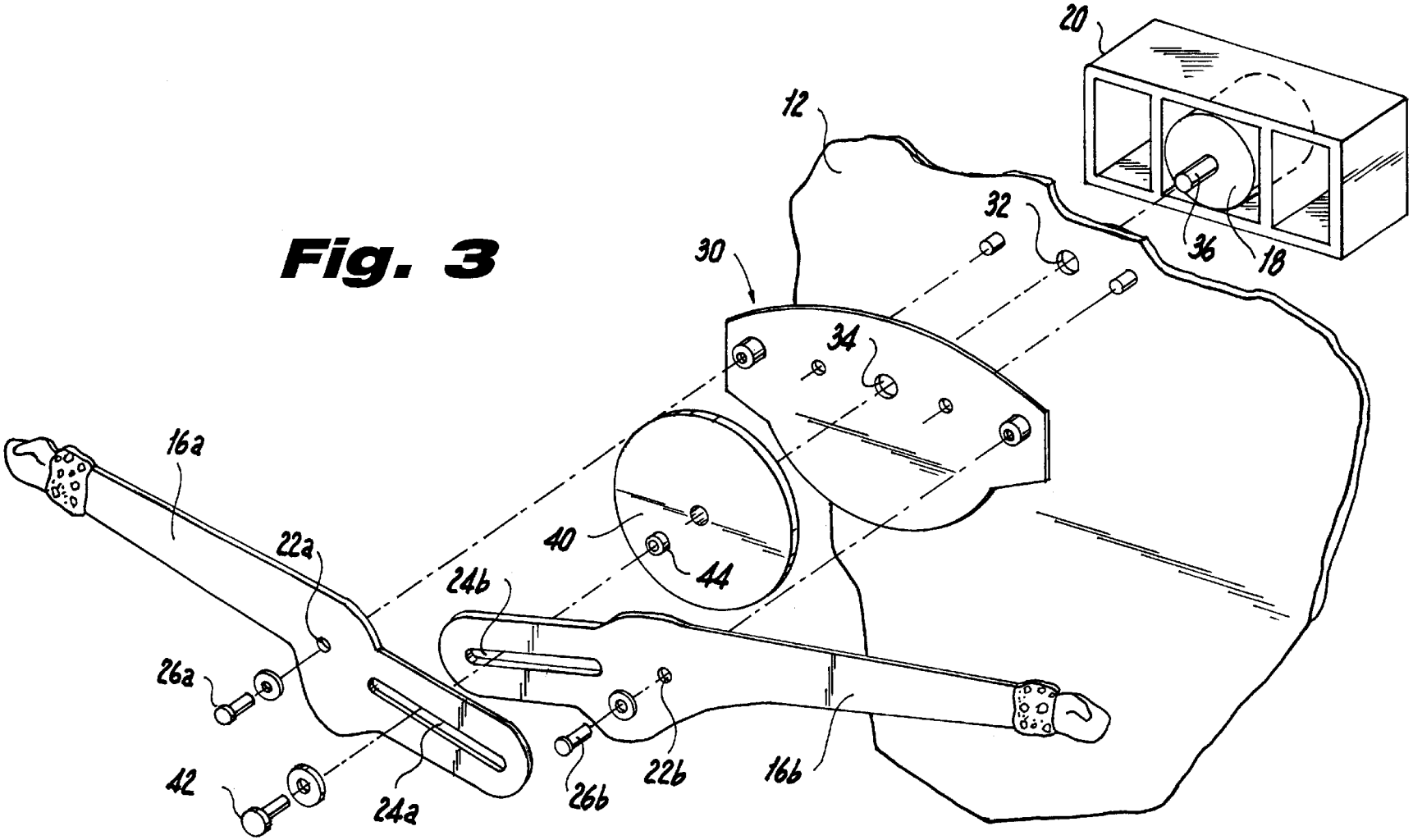
FIG. 3 is an enlarged exploded perspective view of the animated structural components of the display system of FIG. 1 and the drive mechanism associated therewith.

After the artistically arranged inanimate structural components 14 of display system 10 have been assembled and integrated, the animated components 16*a* and 16*b* and the drive system 18 are operatively connected to the base structure 12. In particular, as illustrated in FIG. 3, the animated components 16*a* and 16*b*, which in this case are in the form of a pair of outstretched arms, are each provided with a pivot aperture 22*a*, 22*b* and an elongated an elongated cam slot 24*a*, 24*b*. The pivot apertures 22*a*, 22*b* are dimensioned to receive pivot pins 26*a* and 26*b*, respectively, which independently mount components 16*a* and 16*b* to a support plate 30, which, in turn, is mounted to the base structure 12 of the display system 10. An aperture 32 extends through base structure 12 and a corresponding aperture 34 extends through support plate 30 to accommodate the drive shaft 36 of drive motor 18.

Figure 4:
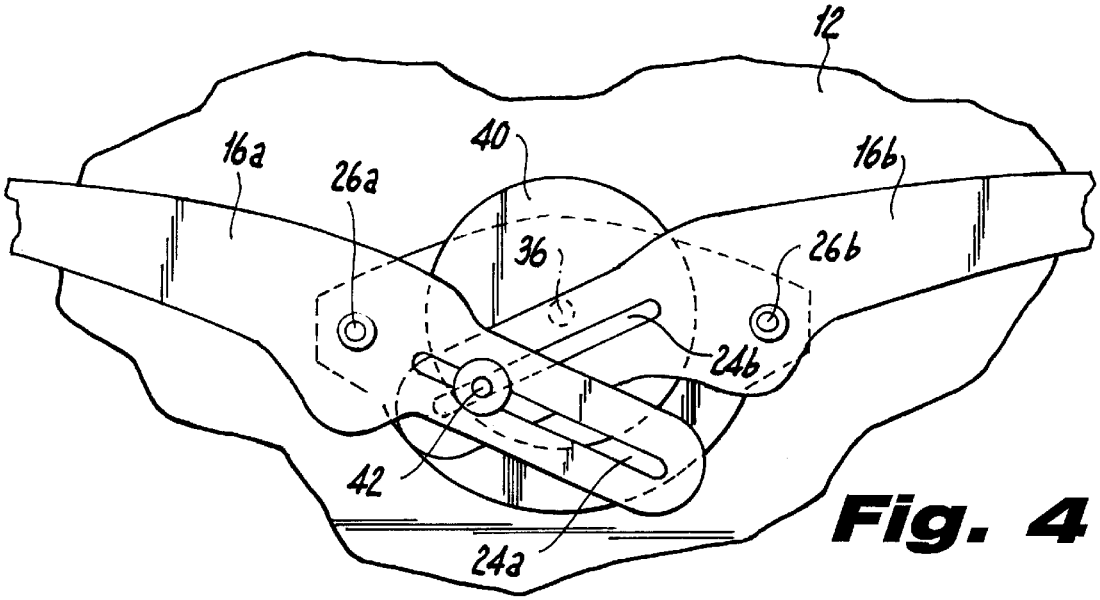
FIG. 4 is an elevational view of the animated structural components of the display system of FIG. 1 in a first orientation.
Figure 5:
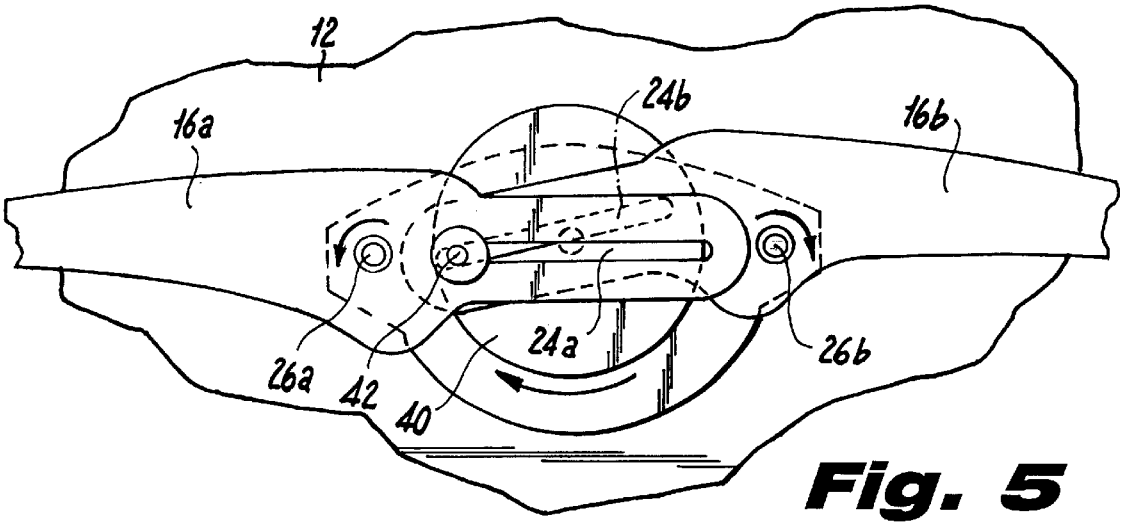
FIG. 5 is an elevational view of the animated structural components of the display system of FIG. 1 in a second orientation in response to the relative motion of a drive mechanism.

A drive disc 40 is mounted on the end of drive shaft 36 and a cam pin 42 extends through the cam slots 24*a*, 24*b* in animated components 16*a*, 16*b* for engagement with a pin retainer 44 on drive disc 40. As shown in FIGS. 4 and 5, in operation, rotation of drive disc 44 about the axis of drive shaft 36 causes the relative movement of cam pin 42 with cam slots 24*a*, 24*b*, resulting in the pivotal movement of animated components 16*a* and 16*b*, about pivot pins 26*a* and 26*b*, respectively, as illustrated in FIG. 1.

Those skilled in the art will readily appreciate that alternative linkage mechanisms can be provided to achieve different modes of animation without departing from the spirit or scope of the subject disclosure. For example, multiple cam arrangements are envisioned that would facilitate motion in different directions and along differing paths. In addition to the camming mechanisms, sliding shaft could be used to transfer motion from the drive motor to the animated structural components of the display system. The components of the mechanical linkage mechanism may be fabricated from any high-strength, light-weight material. However, the linkage components are preferably fabricated from the Sintra material used to fabricate the structural components of the display system as such material is light-weight and self-lubricating. Alternatively, the components of the linkage mechanism may be fabricated from stainless steel. Preferably, the pivot and cam pins are fabricated from acrylic or a similar material.

Figure 6:
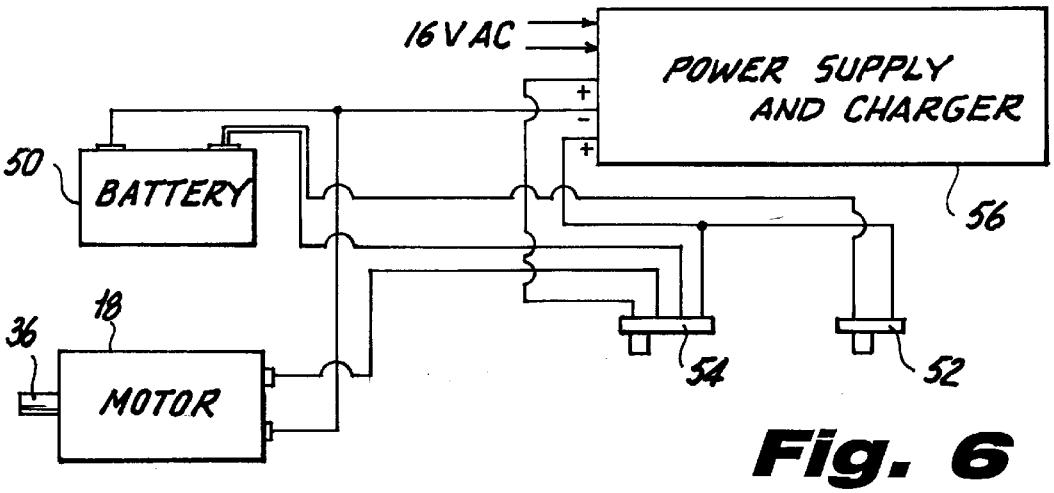
FIG. 6 is a schematic representation of the power circuit for the animated display system of FIG. 1.

Referring to FIG. 6, the drive motor 18 is preferably a low rpm (i.e., 10–20 rpm) low voltage (i.e., 12 vdc–32 vdc) motor, and may be provided with a reduction gear set to achieve the desired animation. The reduction gear set is preferably easily accessible to permit lubrication and the motors is preferably wrapped in insulation for sound absorption. The drive motor 18 is preferably powered by rechargeable battery 50 and a switch 52 is operatively connected to the battery for controlling the operation of drive motor 18. Preferably, the battery has a sufficient capacity to enable the animated display system 10 to function continuously for five to six days without recharge. A second switch 54, in the form of a double pole switch, is operatively associated with the battery 50 and an alternative power supply/charger 56 to selectively disconnect the battery 50 from the drive motor 18 during a recharge period. This permits the animated display system 10 of the subject invention to operate during the recharge period. Preferably, the electrical components of the drive system are electrically connected to one another through conductive pathways provided on a printed circuit board or the like mounted within housing 20.

Control switch 52 can be provided as a manual toggle switch, or a motion detector so that when a person approaches the unit turns on and runs for a predetermined amount of time. Alternatively, the control switch may be in the form of a sound activated switch, or an infrared switch that can be activated remotely with a hand-held remote control unit the control switch could also be in the form of a timer that could be set to energize the motor during a pre-selected time period. It is also envisioned that the motor could be directly connected to an external or remote AC current supply through the power supply/charger 56. In such an instance, a transformer would output 16 VAC to the power supply, which is turn would be converted to 12 VDC for the motors. In addition, while not shown, the power supply could also energize lights for illuminating the artwork, or a mechanical devices such as, for example, a fan generating an air current to impart movement to various features of a display system.

Figure 7:
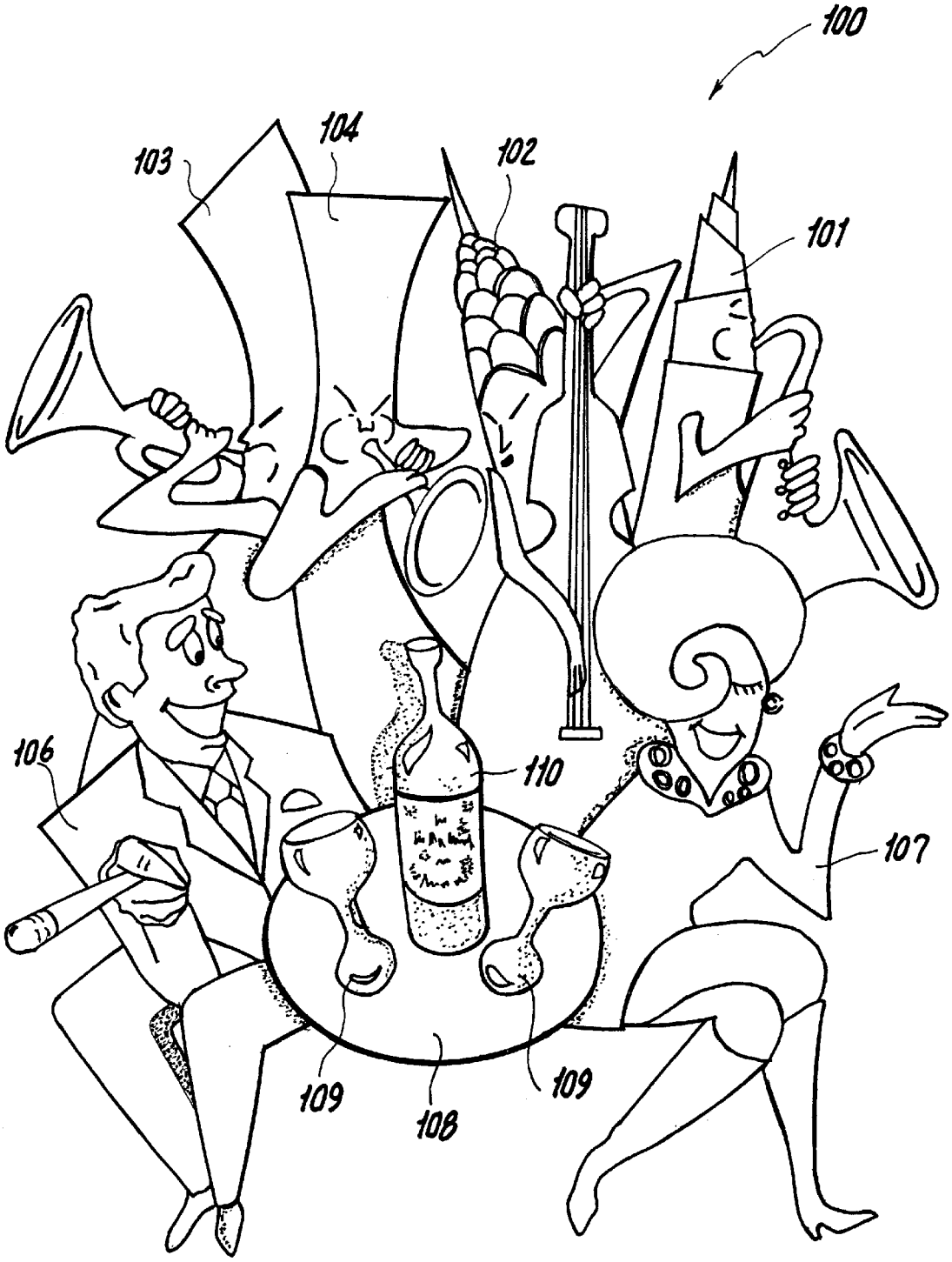
FIG. 7 is a front elevational view of an inanimate display system constructed in accordance with a preferred embodiment of the subject invention.
Figure 8:
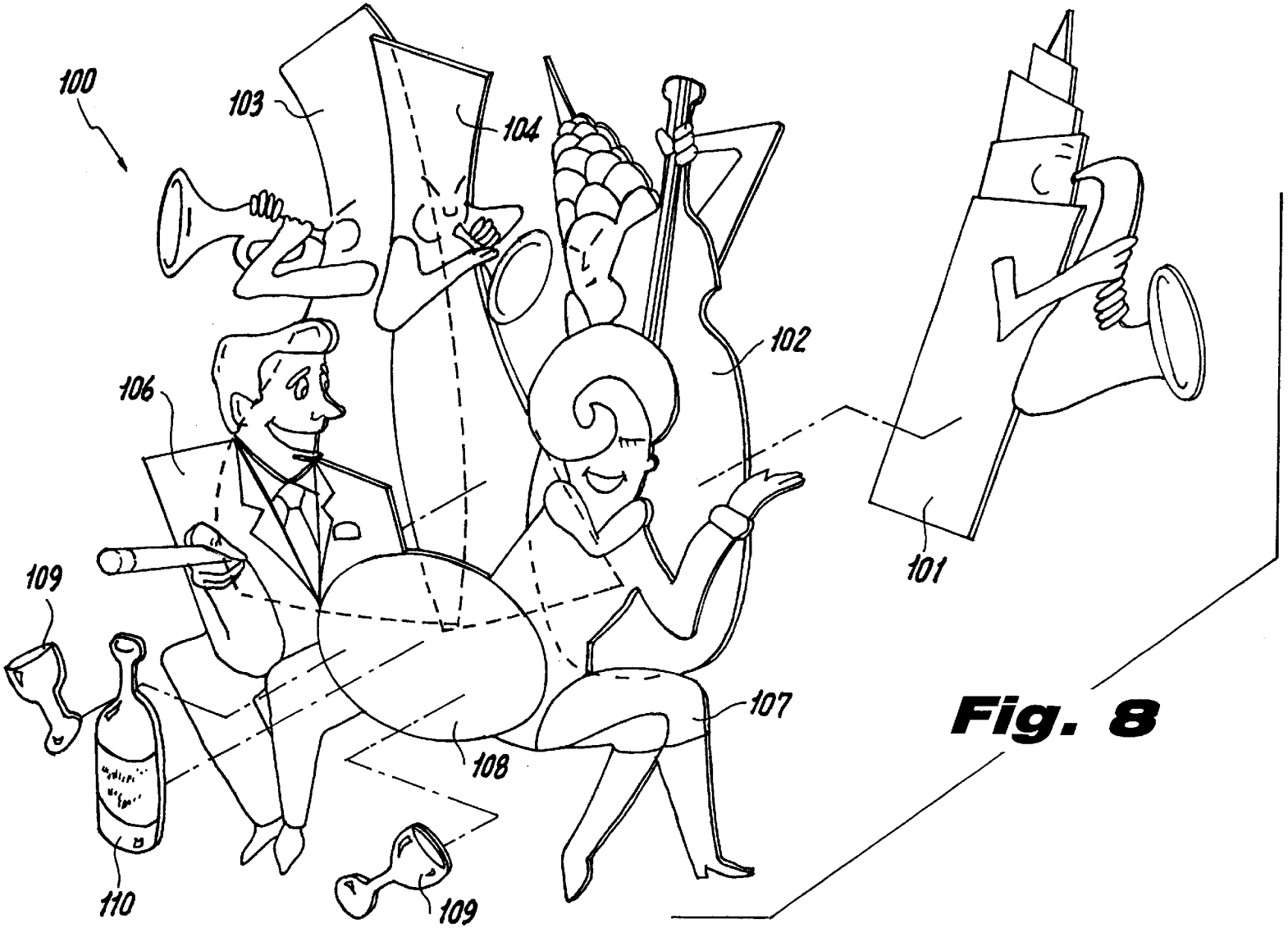
FIG. 8 is an exploded perspective view of the inanimate display system of FIG. 7 with parts separated for ease of illustration.

Referring now to FIGS. 7 and 8, there is disclosed another display system constructed in accordance with a preferred embodiment of the subject invention and designated generally by reference numeral 100. Display system 100 depicts a whimsical scene in a jazz cafe or similar venue, and is constructed in substantially the same manner as display system 10 in that the plurality of structural components which form display system 100 are fabricated from the same materials of construction as display system 10, namely Sintra® material, and they are assembled in the same manner.

In other words, the inanimate structural components of display system 100 are cut to form using a template, hand-painted, and digitized. A corresponding digital image is then applied to each of the structural components, then components are then coated with several layers of lacquer, fastened to one another in a desired orientation to achieve a desired artistic design, and formed into an integral composite structure by applying resin to the unitized structure. The display system 100 includes several relatively large overlaid structural components 101, 102, 103 and 104 which are arranged in such a manner so as to form the base and background for the display. Several other relatively large structural components 105, 106 and 107 are layered upon the base components to define the foreground of the display. In addition, several relatively small structural components 108, 109 and 110 are layered upon the foreground components to create the desired artistic presentation.

Although the systems and methods disclosed herein have been described with respect to preferred embodiments, it is apparent that modifications and changes can be made thereto without departing from the spirit and scope of the invention as defined by the appended claims.

What is claimed is:

1. A method of fabricating a display system comprising the steps of:

a) forming a base structure having a display surface and a plurality of structural components each having a display surface;

b) providing artwork on the display surface of the base structure and each of the structural components;

c) applying lacquer to the display surface of the base structure and each of the structural components to enhance and preserve the artwork provided thereon;

d) arranging the plurality of structural components with respect to the display surface of the base structure in a predetermined orientation so as to achieve a desired artistic presentation; and e) coating the base structure and plurality of structural components with a resin so as to form the base structure and plurality of structural components into a composite structure.

2. A method according to claim 1, further comprising the steps:

a) providing at least one additional structural component having a display surface with artwork provided thereon;

b) applying lacquer to the display surface of the at least one additional structural component to preserve and enhance the artwork provided thereon; and c) mounting the at least one additional structural component to the composite structure in such a manner so as to facilitate relative motion of the at least one additional structural component with respect to the composite structure.

3. A method according to claim 2, further comprising the step of providing means for facilitating relative motion of the additional structural component with respect to the composite structure.

4. A method according to claim 2, further comprising the step of providing a motor and operatively associated mechanical linkage assembly for facilitating relative motion of the additional structural component with respect to the composite structure.

5. A method according to claim 4, further comprising the step of providing a rechargeable power source for powering the motor and driving the operatively associated mechanical linkage assembly to facilitate relative motion of the additional structural component with respect to the composite structure.

6. A method according to claim 2, further comprising the step of mounting the motor and operatively associated mechanical linkage assembly to the composite structure.

7. A method according to claim 1, wherein the step of forming a substantial planar base structure having a display surface and a plurality of structural components each having a display surface comprises the step of forming the base structure and plurality of structural components from a thermoplastic material.

8. A method according to claim 1, wherein the step of providing artwork on the display surface of the base structure and each of the structural components comprises the step of providing an image produced by at least one of silk-screening, hand painting, or digital imaging.

9. A method according to claim 8, further comprising the step of mounting an image on the display surfaces of the base structure and each of the structural components prior to the step of applying lacquer to the display surface of the base structure and each of the structural components.

10. A method according to claim 1, wherein the step of applying lacquer to the display surface of the base structure and each of the structural components comprises the step of applying at least three layers of lacquer to the display surface of the base structure and each of the structural components.

11. A method according to claim 1, wherein the step of arranging the plurality of structural components with respect to the display surface of the base structure in a predetermined orientation further comprises securing the plurality of structural component and base structure to one another.

12. A method according to claim 1, wherein the step of coating the base structure and plurality of structural components with a resin so as to form the base structure and plurality of structural components into a composite structure, further comprises the step of preparing the resin from a two part mixture.

13. A display system comprising:

a) a base structure having a display surface, the display surface of the base structure having artwork provided thereon;

b) at least one inanimate structural component having a display surface, the display surface of the at least one inanimate structural component having artwork provided thereon, the inanimate structural component mounted with respect to the display surface of the base structure in a predetermined orientation so as to achieve a desired artistic presentation;

c) at least one animated structural component structural component having a display surface, the display surface of the at least one animated structural component having artwork provided thereon, the at least one animated structural component mounted for movement with respect to the base structure and the at least one inanimate structural component;

d) a mechanical linkage assembly mounted to the base structure and connected the animated structural component to facilitate the relative motion thereof with respect to the base structure and the at least one inanimate structural component; and e) means operatively associated with the mechanical linkage assembly for imparting motion to the animated structural component.

14. A display system as recited in claim 13, further comprising a rechargeable power source for powering the motor.

15. A display system as recited in claim 13, further comprising switching means for controlling operation of the means for imparting motion to the animated structural component.

16. A display system as recited in claim 15, wherein the switching means comprises a motion activated switch.

17. A display system as recited in claim 15, wherein the switching means comprises a sound activated switch.

18. A display system as recited in claim 15, wherein the switching means comprises a manually activated switch.

19. A display system as recited in claim 15, wherein the switching means comprises an light activated switch.

20. A display system as recited in claim 13, wherein the base structure, at least one inanimate structural component, and at least one animated structural components are formed from a thermoplastic material.

* * * * *